United States Patent [19]

Moulin

[11] 4,133,593

[45] Jan. 9, 1979

[54] PRESSURE SENSITIVE SEAL FOR WIRE AND INTERFACE SEALING OF INDIVIDUAL CONTACTS IN AND BETWEEN ELECTRICAL CONNECTORS

[75] Inventor: Norbert L. Moulin, Placentia, Calif.

[73] Assignee: Hughes Aircraft Company, Culver City, Calif.

[21] Appl. No.: 781,084

[22] Filed: Mar. 25, 1977

Related U.S. Application Data

[60] Continuation of Ser. No. 633,185, Nov. 19, 1975, abandoned, which is a continuation of Ser. No. 423,028, Dec. 10, 1973, abandoned, which is a division of Ser. No. 240,501, Apr. 4, 1972, Pat. No. 3,792,416.

[51] Int. Cl.[2] ..... H01R 13/52

[52] U.S. Cl. ..... 339/94 R

[58] Field of Search ..... 339/59-61, 339/94; 285/109, 110, 111; 174/77 R; 277/31, 27, 189, 205, 207 A, 212 R, 212 F

[56] References Cited

U.S. PATENT DOCUMENTS 3,643,206 2/1972 Cowmeadow ..... 339/94 R

FOREIGN PATENT DOCUMENTS 1665188 2/1971 Fed. Rep. of Germany ..... 339/94 M

*Primary Examiner*—Joseph H. McGlynn

*Attorney, Agent, or Firm*—Lewis B. Sternfels

[57] ABSTRACT

Electrical pin and socket contacts, contained within connectors and interconnectable with one another by mating connection of the connectors, are sealed from the environment external to the interior of the connectors and the connection therebetween regardless of changing pressure conditions. Individual pressure-sensitive wire seals are utilized for each contact at the rear of the connectors and a two sided pressure-sensitive interface seal is utilized for sealing between two mating connectors. The pressure-sensitive wire seal at the rear of each connector includes a tubular portion jacketed in sealing contact on the conductor insulation, a cup-shaped flange opening toward the rear of the connector, a wiper land inwardly disposed of the cup-shaped land, and an interlocking engagement between the seal and the wire-receiving end of the contact. The pressure-sensitive interface seal sealingly engages each pin end of the pin contact and has a pair of cup-shaped seals facing each other and facing the front faces of the two connectors when each pin contact in one connector engages the socket contact of the other connector.

18 Claims, 23 Drawing Figures

PRESSURE SENSITIVE SEAL FOR WIRE AND INTERFACE SEALING OF INDIVIDUAL CONTACTS IN AND BETWEEN ELECTRICAL CONNECTORS

CROSS REFERENCE TO RELATED APPLICATIONS

This is a continuation of application Ser. No. 633,185, filed Nov. 19, 1975 now abandoned, which is in turn a continuation of application Ser. No. 423,028 filed Dec. 10, 1973, now abandoned, which is a division of application Ser. No. 240,501 filed Apr. 4, 1972, now U.S. Pat. No. 3,792,416 patented Feb. 12, 1974.

BACKGROUND OF THE INVENTION

1. Field of the Invention

The present invention relates to a seal, a system and a method for individually sealing electrical contacts in connectors and between mating connectors and, in particular, to such a system and method which maintains the electrical integrity of connection regardless of changing pressures.

2. Description of the Prior Art and Background

An electrical connector, including an insulation body, contacts and seals, in connecting one electronic component to another, must be constructed so as not to impair the quality or transmission of conveyed signals and, consequently, must be electrically secure from short circuiting and arcing, for example. Furthermore, since the signals to be transmitted will dictate the size of wire utilized in the connectors, the connectors must be capable of accommodating different sizes of wires, yet not fail in compromising the electrical integrity. Generally, electrical connectors are subject to failure at one of several points, at least where the cable enters each connector at its rear faces and where the contacts mate at the front face of the connectors. Such failure is caused by arcing and short circuiting between wire and/or contacts due to the fact that conductive fluids such as salt laden air, provide a conductive path which is capable of making electrical contact between adjacent cables and/or contacts.

To overcome these problems relating to arcing and short circuiting, one of two conventional methods have been utilized. A first conventional method provides a resilient, insulating wafer which is usually bonded to the wire or rear end of a rigid connector block. The wafer is apertured to permit insertion of a contact into the connector block and sealing means in the wafer engages the wire which is attached to the contact. To prevent possible deterioration of the bond between the wafer and the connector block upon repeated flexing of the wires, an additional rigid wire guide is bonded to the rubber wafer. Furthermore, the wafer and, in particular its sealing means, is subject to damage upon insertion of the contact through the wafer by the metal edges of the contact and contact insertion tools.

Also, it is conventional to utilize insulated wires of different diameters; however, it is not economically feasible to design a wafer for each combination of wire sizes. As a consequence, a standard sized wafer is used with the result that its holes will not be altogether suitable for all sizes of wire. Finally, a particular electrical connector may require the use of wires having a large diameter which, although adequately being sealed within individual holes of the wafer, expand the holes to such an extent that it eventually becomes extremely difficult, if not impossible, to insert the remaining wires into the connector body without damage to the rubber wafer, bond joints or connector body.

Even when this type of conventional connector block operates properly, its use results in a fairly high cost of materials, assembly, testing and replacement. Since such a connector requires at least two components, the cost of assembly is relatively high because at least one assembly operation is required along with complete bonding of the wafer to the connector block and electrical and seal testing thereof in order to prevent the possibility of electrical failure. If a defect in the bonding is found, it is often necessary to scrap the entire connector either because it is not possible to effect a repair without the destruction of the wafer or because it is too time consuming and expensive to make such a repair.

To overcome the aforementioned problems, another connector sealing scheme pots and encapsulates the wires and contacts into the wire side of the connector block with polyurethane or epoxy materials. While this method substantially eliminates these problems, its use results in a permanent fixture which prevents later removal or exchange of contacts in the event of required wiring changes or should contacts be or become faulty.

Other problems are associated with the interface seal between two mating connectors. This seal also comprises a resilient, insulating wafer with a plurality of holes therethrough so that a pin contact may engage with its corresponding socket contact. Because mating connectors must often be separated, it is not possible to bond one connector body to the other; therefore, the interface seal must be capable of sealing without benefit of potting or other bonding means, at least on both connector bodies. Conventionally, the two connector bodies with the seal therebetween are clamped together under great pressure to maintain sealing integrity. It has been determined that as much as 85 psi clamp pressure must be utilized to maintain a seal of 30 psi pressure. Unfortunately, even with such clamping pressures, these interface seals are still subject to failure, such as may arise because of misalignment of contacts.

In both cases with rear wire seals and interface seals, conventional apparatus is still subject to other problems arising from changes or differentials in pressure differential. For example, a connector may be moved from ground level to a higher atmosphere and back to ground or sea level, such as by an airplane. At higher atmospheres, atmospheric pressure drops and any fluids or gases within the connectors exhaust to stabilize its internal pressure with the external pressure. Upon return of the aircraft to ground level, the pressure external to the connector is greater than the internal pressure, thereby permitting contaminants to be drawn into the connector interior should the seal be inadequate. This problem becomes particularly oppressive near or on the ocean where salt deposits permit rapid deterioration of electrical integrity by short circuiting.

This problem becomes aggravated with the use of helically wound insulation which acts as a wick.

SUMMARY OF THE INVENTION

The present invention overcomes these and other problems by utilizing separate seals which are individually coupled to each insulated conductor and contact combination, which enables the use of single pin and socket connector bodies of increased width. Briefly, the invention includes a first seal as a pressure-sensitive wire seal at the rear face of the connector and a separate pressure-sensitive interface seal at the confronting front faces of the bodies of the intermating connectors. Both the wire seal and the interface seal utilize a cup-shaped element which opens toward the respective front and rear faces of the connector body, that is, towards the exterior of the contact receiving bores in the body. Thus, a pair of cup-shaped elements normally seal each internal connector block bore into which a contact is positioned.

Although the cup-shaped seals exert a normal sealing pressure to seal the interior portion of the bore, a greater or enhanced sealing occurs when the pressure external to the bore increases by exerting increased sealing pressure against the cup-shaped seals. The wire seal is secured to the wire-receiving end of the contact and is provided with a tubular sleeve which snugly fits over and is sealed to the insulation covering a wire or conductor coupled to the contact. Enhanced sealing also is provided between the tubular sleeve and the insulation and further avoids the wicking problems of helically wound insulated conductors, due to the tubular sleeve's ability to conform to the configuration of the conductor insulation. Therefore, when the contact and its attached seal are inserted within the connector body bore, the problems in inserting the contact through a seal, as previously required by the prior art, is avoided.

The pressure-sensitive wire seal is common to both pin contacts and socket contacts. When both contacts with attached wire seals are positioned in their respective blocks, an interface seal having a pair of cup-shaped seals facing one another is placed over the pin end of the pin contact so that the cup-shaped seal adjacent to the pin connector body seals the bore from which the contact pin extends. When the pin of the pin contact is engaged with the socket of the socket contact, and the two pin and socket bodies are brought together, the second cup-shaped seal is inserted within the bore in which the socket contact is positioned, thereby forming a seal for the socket connector body. Since the cup-shaped seals function without need for clamping pressure, the spacing between the pin connector and the socket connector becomes vastly less critical than with prior art connectors. All that is needed, if desired, is a simple clamp to prevent vibration, rough handling or the like from accidentally separating the two connectors.

The connector bodies have widths which are increased with respect to those of the prior art to provide an elongted body bore for complete protection of the contact with attached cable, even during flexure of the cable. However, the body width is less than the total seal and body width of the prior art, thus providing a total smaller connector width.

To assemble the pressure-sensitive wire seal on the contact, the seal is slipped over the contact prior to connecting the wire thereto. Then, the cable, as stripped, is inserted through the seal and into the wire-receiving end of the contact wherein the wire may be crimped or soldered or otherwise attached therein. It is then only necessary to couple the contact-seal-cable assembly into the connector body by use of any suitable means, such as by use of the apparatus described in U.S. Pat. No. 3,614,824. The interface seal is slipped over the pin end of the pin contact and the two connector bodies with seals, contacts and cables in place are interconnected to complete the assembly.

If one or more contacts or seals should test faulty, it is only necessary to remove the individual faulty parts and repair or replace them. Inspection is also facilitated.

It is, therefore, an object of the present invention to provide an improved pressure-sensitive sealing system and method.

Another object is to provide an improved sealing system and method for electrical connectors and contacts therefor.

Another object is to provide an individual sealing capability for electrical contacts.

Another object is to provide a sealing system and method with enhanced sealing capabilities under varying and, in particular, increased pressure conditions.

Another object is to provide such a system and method for enhancing electrical integrity of connectors.

Another object is to provide such a system and method for enabling insertion of contacts into connector bodies without damage to the seals.

Another object is to provide such a system and method which is amenable to drawing contacts into a connector body from the rear face thereof.

Another object is to provide such a system and method not requiring clamping pressures to effect a seal.

Another object is to provide such a system and method which is amenable to easy inspection.

Another object is to provide such a system and method for enhanced protection of contact and cable assemblies with small width connectors.

Another object is to provide such a system and method capable of sealing despite misalignment of parts.

Another object is to provide such a system and method capable of easy and inexpensive replacement and repair of individual connector parts.

Another object is to provide such a system and method having reduced weight vis-a-vis prior art connectors.

Another object is to provide such a system and method for providing inexpensive connectors.

BRIEF DESCRIPTION OF THE DRAWINGS

Other aims and objects as well as a more complete understanding of the present invention will appear from the following explanation of exemplary embodiments and the accompanying drawings thereof, in which.

DESCRIPTION OF THE PREFERRED EMBODIMENTS

Figure 1:
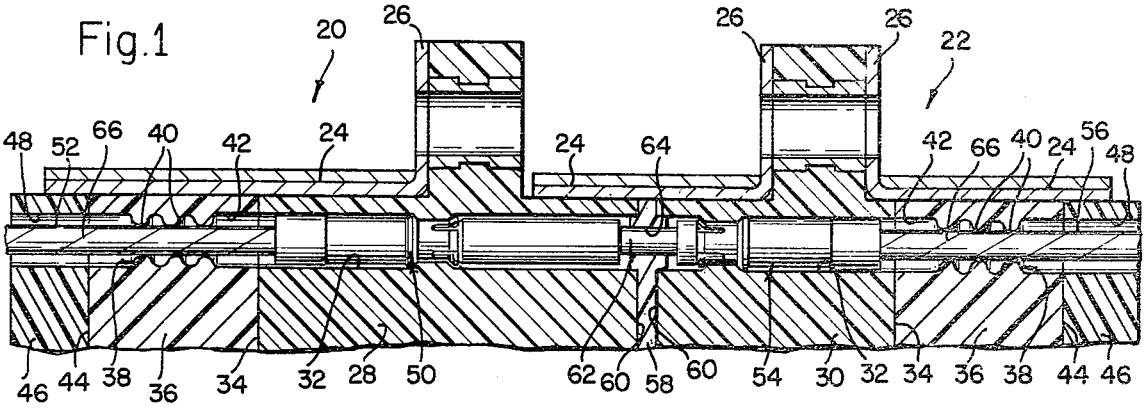
FIG. 1 depicts a prior art connector assembly utilizing prior art sealing concepts which are displaced by the present invention.

Accordingly, FIG. 1 illustrates a prior art connector and sealing scheme including a pair of connectors 20 and 22, the first being a pin connector and the second being a socket connector. The connectors are held together by one of several pressure-applying attachment means as are well-known in the art. The connectors respectively include a pin connector body 28 and a socket connector body 30 through which a plurality of bores 32 extend. The bodies are of a rigid, insulating material. At the rear faces 34 of the respective connector bodies are a pair of resilient, electrically insulating wafers 36 having a through bore 42 with sealing means 38 therein illustratively embodied as annular ridges 40 (see, for example, U.S. Pat. No. 3,425,024). To the back faces 44 of wafers 36 are bonded a pair of wire guides 46 of a rigid insulating material also having through bore means 48. Within bore means 32, 42 and 48 of pin connector 20 is disposed a pin contact 50 to which is secured an insulated conductor 52 in a manner well known in the art. In a similar manner, a socket contact 54 is positioned within bores 32, 42 and 48 of socket connector 22 with a cable 56 secured to the socket contact. When connectors 20 and 22 are brought together in a face-to-face arrangement, each pin contact 50 is engaged within each socket contact 54. Electrical insulation for the mating contacts is provided by an interface wafer 58 between the confronting front faces 60 of the connectors. Wafer 58 includes a plurality of holes 64 in sealing engagement about each pin end 62.

In order to properly seal wafer 58 between connector bodies 28 and 30, it is necessary to compress the interface wafer by rigidly securing the connectors together by some pressure-applying attachment, such as a clamp. A sealing force as much as 85 psi clamp pressure is not uncommon. Sealing by means of annular ridges 40 at the rear of the connectors is effected by a close fit of cables 52 and 56 within the ridges, as more fully explained in above-mentioned U.S. Pat. No. 3,425,024. Although a specific sealing arrangement for pin and socket contacts within and between connector bodies has been shown, it is to be understood that the above description is representative of the many prior art means by which electrical sealing and insulation of contacts has been accomplished. For example, sealing at the rear faces can be effected by other resilient means or by a potting material, should it not be desired to afford the connectors with a contact removal capability.

Such prior art cables have functioned well, however, it is known that they are subject to failure, primarily because of arcing between contacts. Such arcing usually results when a conductive fluid, such as salt water or spray, is deposited around the seals, especially at leaky bonding points. Such leaks generally arise during manufacturer or use of the connectors when the bonds fail at faces 34 or 44 or at the sealing engagement at front faces 60, thereby affording a substantially shortened arcing path or conductive fluid path from one connector to another, as distinguished from the longer path through the entire bore series of bores 32, 42 and 48. Generally, the combination of these three bores is sufficient to prevent arcing and, when taken in conjunction with annular ridges 40, the possibility of arcing or electrical conductivity is very small. However, as stated above, if a defect occured, for example, at face 34, the electrical conductive path should be substantially lessened. Further, in order to provide sufficient sealing at faces 60, wafer seal 58 must be sufficiently compressed. Even with proper assembly, repeated changes in altitude create differences in pressure internal and external to bores 32 and 42 and the connectors would "breathe" and draw in conductive fluids, such as salt laden air. Thus, integrity at the bonding faces of the seals could not be assured.

Furthermore, use of resilient means such as sealing means 30 provided further problems with a plurality of insulated conductors having different sizes were to be used with the same connector. Since it is not economically feasible to provide each wafer 36 with bores 42 sized to the particular end use of the connector, a representative bore size would be utilized. As will be readily appreciated, small sized insulated conductors have less sealing pressure applied thereto than larger sized cables. The result is a possible loss of sealing integrity.

An additional problem has arisen with the advent of a lightweight, extremely thin wire insulation, such as a helically wound plastic, in which the helical interface 66 of the plastic winding acts as a wicking means, thus further detracting from the sealing capabilities of the wafer.

Also, all rear positioned wafers, such as wafers 36, are subject to damage in insertion of the pin or socket contacts into their respective bodies 28 and 30 from their rear faces, which damage could prove fatal in assuring the integrity of insulation of the connectors. Another problem exists when the number of cables to be utilized in the connector all have a diameter. Although insertion of the first contacts and cables within the connector bodies is not difficult, as the number of inserted cables are increased, the resilient material of wafers 36 is continually expanded until, at some point, it becomes exceedingly difficult, if not impossible, to insert further contacts, especially without damage to the wafer or its bores.

Finally, in the example described with respect to FIG. 1, a pair of connectors requires seven individual components, not including the shell 24 and 26 and attachment means, and includes a pair of wire guides 46, a pair of wafers 36, a pair of bodies 28 and 30, and an interface wafer 58. Except with respect to at least one face of wafer 58, all the other elements had to be bonded to one another, and thereafter, the partially fabricated connectors are electrically tested to assure that the bonds are, in fact, adequate for insulation purposes. Thereafter, a plurality of testing pin and socket contacts are inserted within the plurality of borer of the connectr bodies, followed by an arcing test of the several testing contacts by grounding alternate connectors and passing signals through the remaining connectors. If any of these tests indicated a malfunction, it was generally less expensive to scrap the connector. Such scraping would result if only one of many insulation means within the bores failed. Obviously, the end result was one of very great cost.

The present invention, as illustrated in FIGS. 2(*a*) through 2(*d*), overcomes all these problems and further provides increased sealing and electrical integrity when pressures external to the bore become greater than pressures within the bore. As shown in these figures a pin connector body 70 having a front face 72 and a rear face 74 is shown positioned adjacent a socket connector body 76 having a front face 78 and rear face 80. Both bodies are formed of a rigid insulating material, such as a plastic. Since the connector bodies 70 and 76 are conventional, except in their length as will become apparent hereinafter, they are shown in partial section to illustrate only a few of many bore or aperture means 82 and 84, respectively of connector bodies 70 and 76. These bore means extend through the entire connector body from the front faces to the rear faces and are generally smooth with the exception of inwardly extending annular shoulders 86 and 88 of reduced diameter.

Each bore means is of sufficient length to completely enclose the contact proper and a large length of insulated conductor attached thereto for protection thereof; thus, the bore means are somewhat longer than those of corresponding prior art bodies, yet provide a length which is less than that of the total bore length of prior art body and wafer combinations.

The bore means or apertures of the respective connector bodies are so positioned therein that they align when the connector bodies are placed in a face-to-face relationship or arrangement of front face 72 to front face 78.

Figure 3:
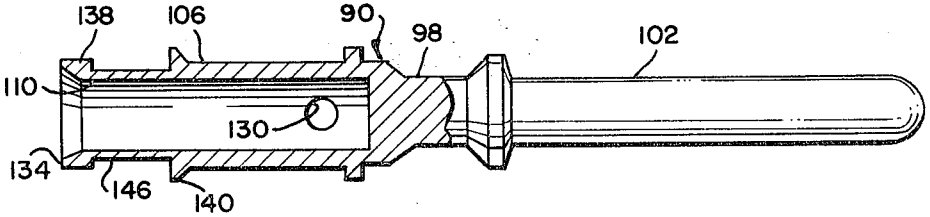
FIGS. 3 and 4 depict novel pin and socket contact bodies respectively utilized in the present invention.
Figure 2C:
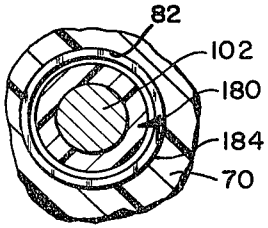
Figure 2B:
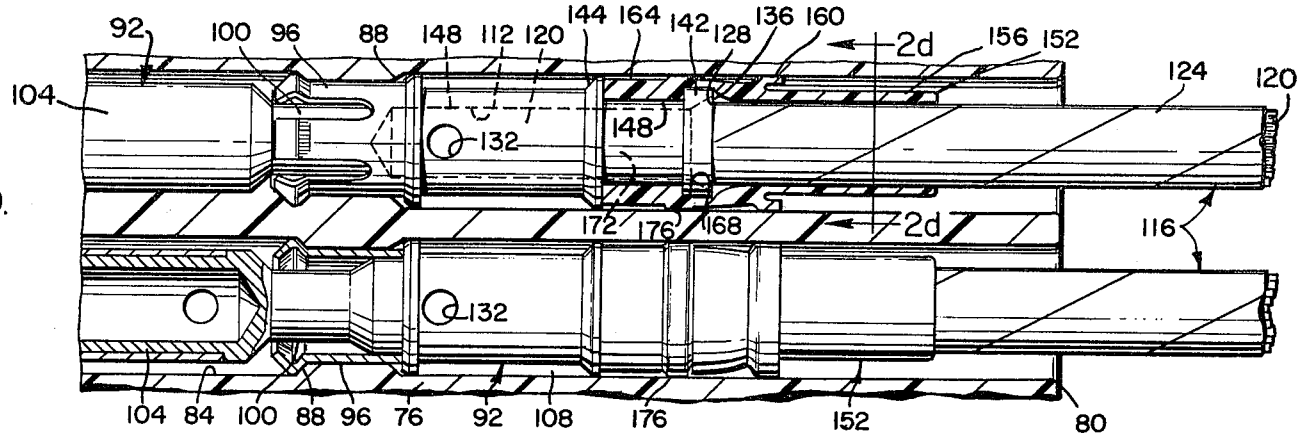
Figure 4:
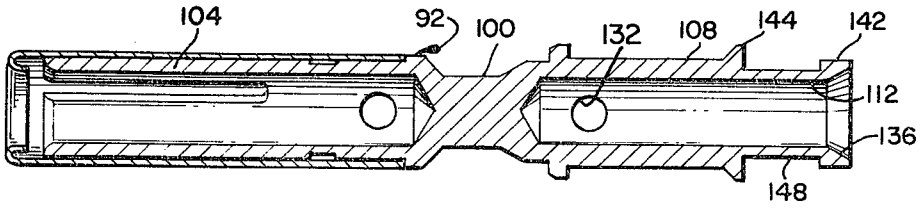
Figure 2D:
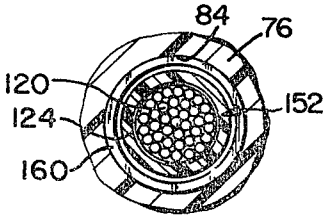
Figure 9A:
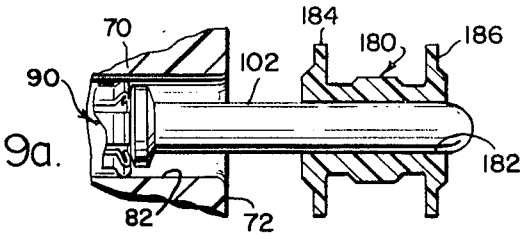
FIGS. 9(*a*)—(*e*) depict the steps whereby the interface seal of FIG. 6 seals the interface connection between a pair of connector assemblies.
Figure 9B:
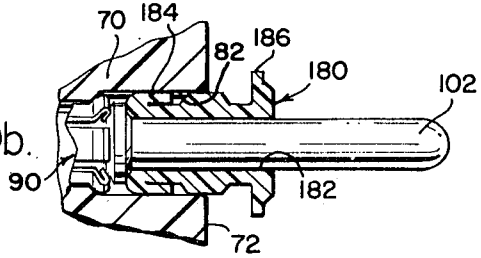
Figure 9C:
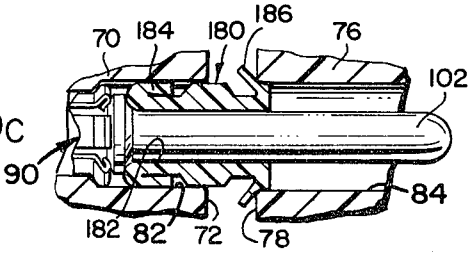
Figure 9D:
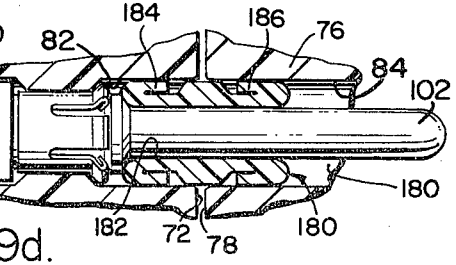
Figure 7A:
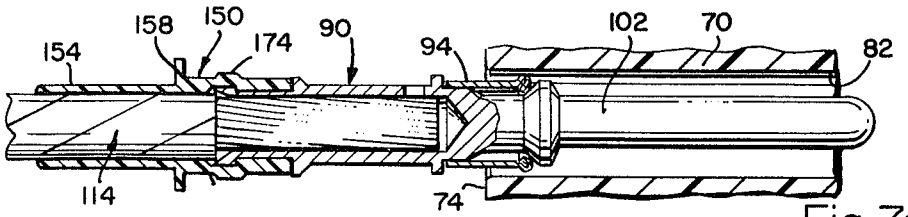
FIGS. 7(*a*)-(*d*) depict the steps by which the inventive pressure-sensitive wire seal as secured to a contact is sealed within the rear face of a connector body.
Figure 7B:
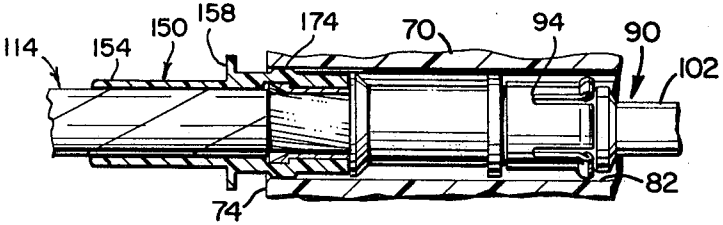
Figure 7C:
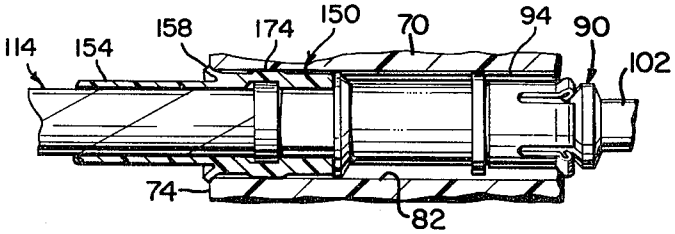
Figure 7D:
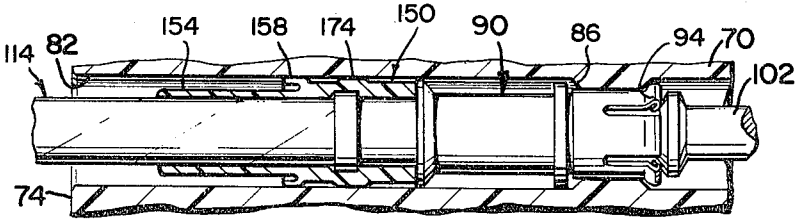

Disposed within each of bore means 82 of pin connector body 70 are a plurality of pin contacts 90 (see also FIG. 3) and within bore means 84 of socket connector body 76 are a plurality of socket contacts 92 (see also FIG. 4). Each of the contacts are provided with retaining clips 94 and 96 which are secured to their respective contacts within recesses 98 and 100. The retaining clips are of a spring material so that when the contacts are inserted within their respective bores, the clips engage their respective shoulders 86 and 88 for latching engagement therebetween.

Each pin contact terminates at its forward end in a forwardly projecting pin end 102 while each socket contact terminates at its forward end in a socket end 104 which are so configured that, when the connector bodies 70 and 76 are in their face-to-face relationship, pin end 102 is received within and electrically engages socket end 104 for electrical connection therebetween.

Each contact is also provided at its rearward end respectively with a rearwardly extending wire-receiving end 106 and 108 having a recessed bore 110 and 112 for reception of respective insulated conductors 114 and 116. The conductors include wire conductors 118 and 120 sheathed within insulation means 122 and 124 and are stripped to points 126 and 128 so that the stripped wire conductors 118 and 120 may be received within their respective recessed bores 110 and 112. These stripped wires are crimped or otherwise soldered therein, holes 130 and 132 providing an access for soldering and inspection of the soldered or crimped assembly. The insulation at points 126 and 128 abut against rear ends 134 and 136 of the contacts.

It is to be understood, however, that insulated conductors 114 and 116 need not be single cables but a plurality of insulated conductors held within a sheathing or other protective covering, such as a cable extending into a bulkhead.

Wire receiving ends 106 and 108 of contacts 90 and 92 are completed by means of a pair of collars 138, 140 and 142, 144, respectively, to provide reduced shank portions 146 and 148. Fitted about annular latching collar 138 and within reduced shank 146 of pin contact 90 and about annular latching collar 142 and within reduced shank 148 of socket contact 92 are respective pressure-sensitive wire seals 150 and 152, resting against annular abutment collars 140 and 144.

Figure 5:
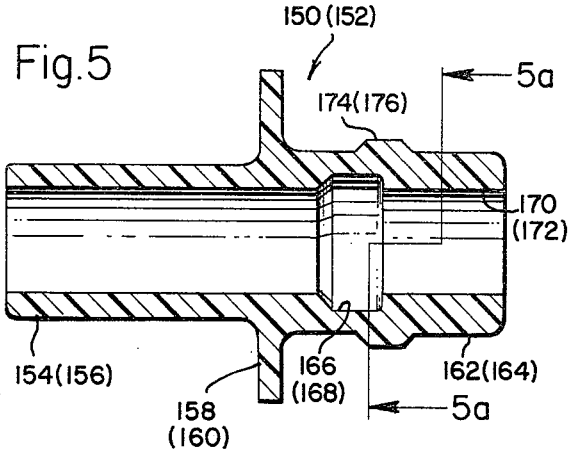
FIG. 5 is a cross sectional view of a pressure-sensitive wire seal embodying the concept of the present invention, FIG. 5(*a*) being a sectional view of the seal of FIG. 5 taken along lines 5(*a*)—5(*a*) thereof.
Figure 5A:
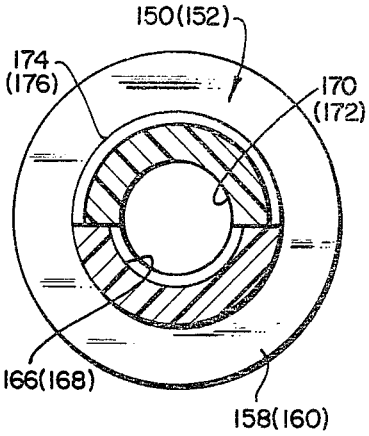

As shown in FIGS. 5 and 5(*a*) each seal is generally tubular in configuration and includes a tubular end portion 154 and 156, a radially extending flange 158 and 160, and a socket gripping front portion 162 and 164. On the interior of each portion 162 and 164 are respective recesses 166 and 168 and flanges 170 and 172. The recesses and flanges of seals 150 and 152 so cooperate with annular latching collars 138 and 142 and recessed shanks 146 and 148 of pin and socket contacts 90 and 92 that the seals can be resiliently held onto their respective contacts. Each seal is completed by respective wiping lands 174 and 176 which are positioned at points straddling the point where collars 138, 142 meet with reduced shanks 146, 148.

Figure 6A:
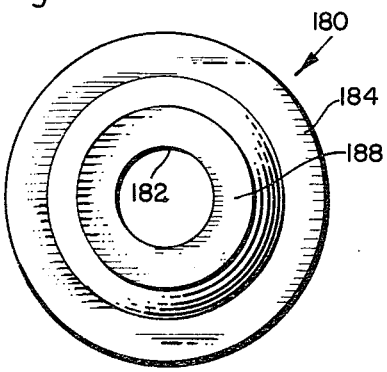
FIG. 6 depicts the inventive interface seal for use between a pair of connector assemblies, FIG. 6(*a*) being an end view of the seal of FIG. 6 taken along line 6(*a*-)—6(*a*) thereof.
Figure 6:
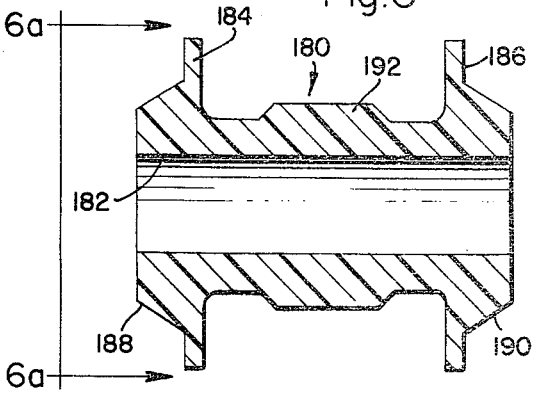
Figure 2A:
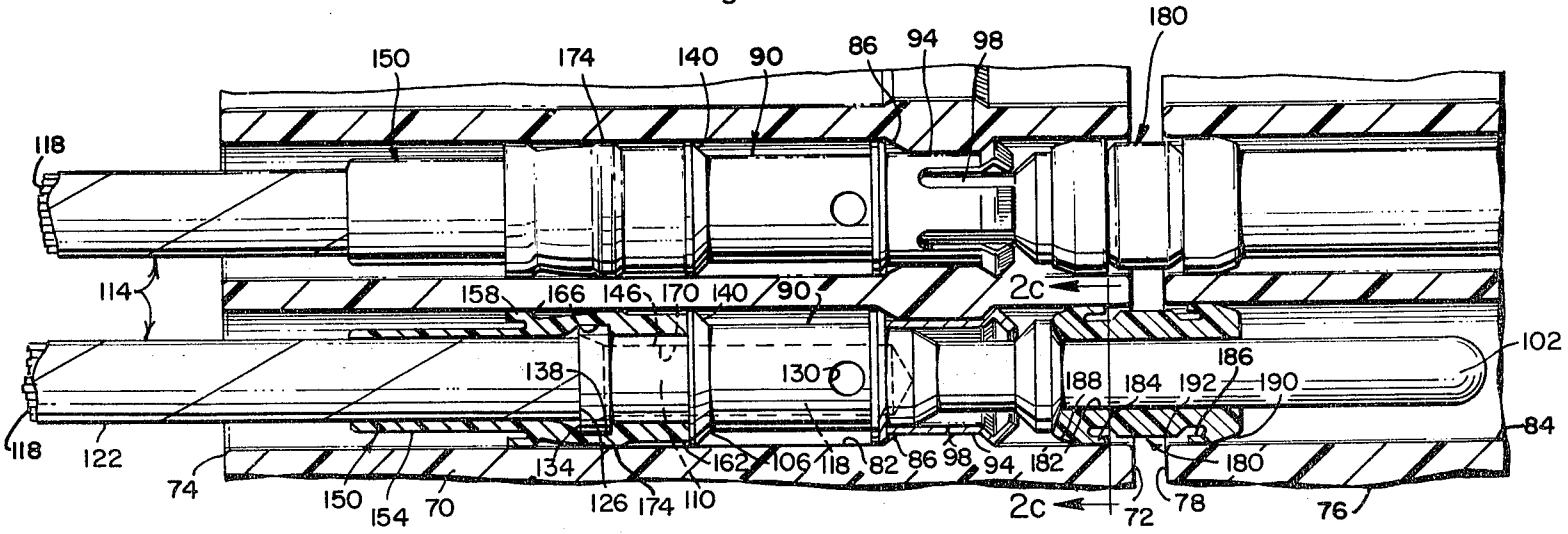
FIGS. 2(*a*) and 2(*b*) illustrate in section and partial section a pair of mating connector assemblies sealed according to the concept of the present invention, FIGS. 2(*c*) and 2(*d*) being sections taken along line 2(*c*)—2(*c*) and 2(*d*)—2(*d*) respectively in FIGS. 2(*a*) and 2(*b*)

At the interface point between connector bodies 70 and 72 is a pressure-sensitive interface seal 180, as shown in FIGS. 6 and 6(*a*). This seal is provided with an internal bore 182 having a dimension which is designed to snugly fit about pin end 102. At both ends of seal 180 are a pair of flexible, radially extending flanges 184 and 186 which are adapted to be positioned within bores 82 and 84 of the connector bodies. Terminating seal 180 are reinforcement portions 188 and 190 with an additional reinforcement 192 at the center of the seal.

In the assembly of the present invention, it is preferred first to place a pressure-sensitive wire seal on its respective contact, then to affix the insulated conductor into the assembled seal and contact, and finally to insert the contact with seal and wire into the bores of the connector bodies.

Placement of the pressure-sensitive wire seal is effected, for example with respect to pin contact 90 and seal 150, by manipulating socket gripping portion 162 over annular collar 138 in such a manner that flange 170 of the seal fits within shank 146 of the contact while recess 166 of the seal is engaged about collar 138 of the pin contact.

Thereafter, insulated conductor 114 with the insulation stripped to point 126 is slid within seal 150 through tubular end portion 154 until stripped end 126 abuts rear end 134 of the contact. The portion of the contact forwardly of annular collar 140 is then crimped about the bared wire portion 118 by conventional crimping operations or, alternatively, solder may be flowed through hole 130. Since tubular portion 154 snugly fits about insulation 122 of conductor 114, a sealing fit is effected. A similar assembly procedure is accomplished for the socket contact.

After the assembly of the pin and socket contacts with their insulated conductors and pressure-sensitive wire seals thereon, the assembly is now ready for insertion of each contact within the bores of the conductor bodies, as illustrated by FIGS. 7(*a*)–(*d*) with respect to one of the pin contacts. Such insertion may be accomplished by means of the tool described in U.S. Pat. No. 3,614,824, which is inserted within pin connector body 70 from its front face 72. Such a tool grips pin end 102 and draws pin contact 90 into the connector body through rear face 74 and into bore 82. Initial insertion of the pin contact into the bore is depicted in FIG. 7(*a*). As the pin is further drawn within the bore, wiping land 174 first makes contact with the bore and cleans the contact cavity prior to entry of annular flange 158, as shown in FIG. 7(*b*). Upon still further drawing of the pin contact into the bore, annular flange 158 meets the bore at rear face 74, as shown in FIG. 7(*c*), thereby beginning to deform flange 158 into its sealing cup-shaped configuration. Upon complete insertion of the contact within the bore, flange 158 completely deforms as depicted in FIG. 7(*d*) while, at the same time, retaining clip 94 snaps over annular shoulder 86 to retain the contact within connector body 70. A similar procedure is effected for each socket contact 92 and its associated parts.

As a consequence of this assembly, each contact is well recessed within its bore 82 or 84 from the connector body rear face so that an appreciable length of insulated conductor is also protected. This arrangement prevents loosening of the conductor from its contact upon flexure or bending of the conductor during assembly or after installation, such as in small spaces, and also prevents unsealing of the conductor from the tubular portion of the pressure-sensitive wire seal during such flexure or bending. Nevertheless, the end result is a single piece connector of smaller width than those, for example, depicted in FIG. 1.

Figure 8:
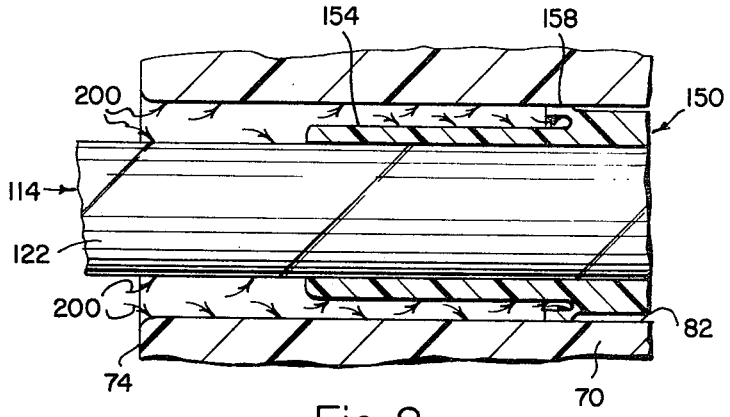
FIG. 8 depicts the sealing principle of the present invention.

As shown in FIG. 8 with illustrative respect to pin contact 90, sealing of the contact at its rear portion is provided by three seals including gripping contact of tubular portion 154 on cable 114, a sealing fit between wiping land 174 and bore 82, and contact between cup-shaped deformed flange 158 and the interior of the bore.

Further, the sealing capability is increased when pressure, as denoted by arrows 200 is exerted on seal 150. This pressure not only increases pressure of tubular portion 154 against insulation 122 but also increases the sealing contact of cup-shaped land 158 against bore 82 because land 150 faces toward the exterior of the connector body. If, however, the pressure exterior to the body were less than that within the interior, any fluids within the body would exhaust past land 158, such as if a vehicle carrying the connector were raised in altitude. However, upon return to sea level or even beneath the sea, the external pressures would increase the sealing contact of tubular portion 154 and cup-shaped seal 158 to prevent leakage of fluid into the connector body.

Figure 10:
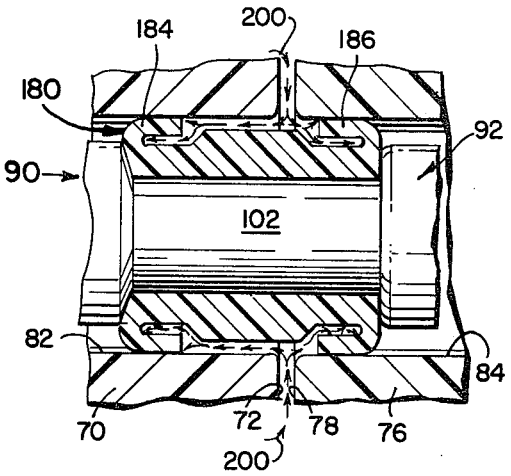
FIG. 10 illustrates the sealing principle of the interface seal of FIG. 6.
Figure 9E:
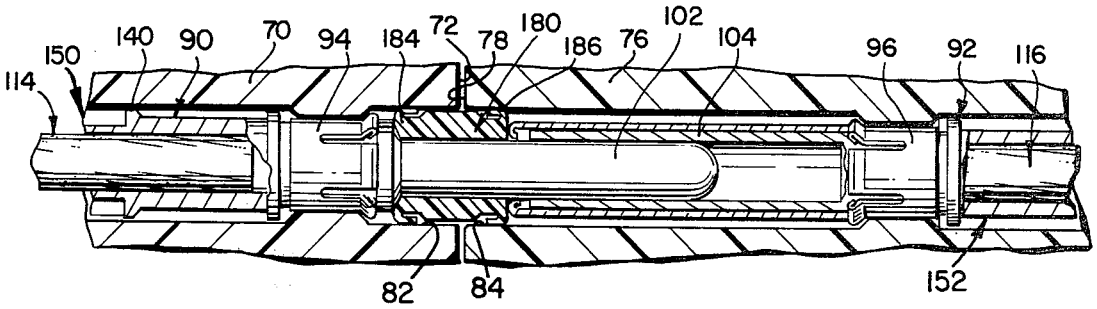

A similar condition exists with interface seal 180, as depicted in FIGS. 9(*a*)–(*e*) and FIG. 10. After the pin contact has been retained within its body as described above, interface seal 180 is then slipped onto pin end 102, as shown in FIG. 9(*a*), to closely fit and seal bore 182 on the pin end. The seal may be further pushed along the length of the pin end in order to engage bore 82 at front face 72 of pin connector body 70, shown in FIG. 9(*b*). Insertion of flange 184 within bore 82 deforms the flange into a cup-shaped configuration and, as illustrated in FIGS. 9(*c*)–9(*e*), when socket connector body 76 with its socket contacts are placed in face-to-face arrangement with the pin connector body, flanges 106 deform into cup-shaped configurations as they interengage with bores 84 of the socket connector body. As shown in FIG. 10, pressure depicted by arrows 200 bear against the cup-shaped flanges 184 and 186 to increase the sealing action thereof in a manner similarly described above.

Furthermore, the combination of cup-shaped flange 158 of seal 150 and cup-shaped flange 184 of seal 180 in the kin connector body and their corresponding cup-shaped flanges 160 and 186 of the socket connector body insure that the interior of the two bodies are maintained in a sealed condition, thus preventing undesired electrical contact, other than as provided, and shorting between contacts.

Figure 11:
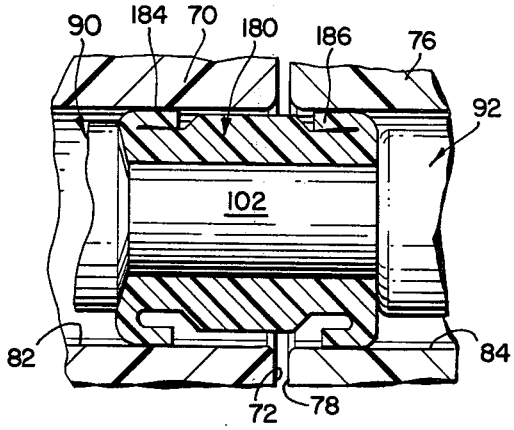
FIG. 11 depicts an interface seal in sealing relationship with a pair of connector assemblies to illustrate noncriticality of positioning of contacts.

Also, because of the reasons described in conjunction with FIG. 10, there need be no clamping force maintained between the two connector bodies to insure proper sealing of interface seal 180, which further can be offset as illustrated in FIGS. 10 and 11 and still provide its function. As shown in FIG. 11, precise alignment of the contacts within their bores is not required since the respective cup-shaped flanges permit a relatively high degree of misalignment while still permitting proper function of the seals.

Finally, should a contact or seal exhibit failure during testing, only the defective part need be readily removed and repaired or replaced rather than a wafer seal, as in the prior art, and, because of the simplicity of the design, all parts are amenable to facile inspection due to the absence of bonded joints and the like.

The present invention has been subject to various design verification tests which have proved the sealing concept herein disclosed. Among several of the tests conducted were immersion tests for leakage, voltage testing of the dielectric, insulation resistance tests, and altitude breathing tests under several conditions of normal atmosphere, salt spray atmosphere, and repetition of subjecting the connectors to change in altitude exceeding 90,000 feet, and under water tests containing salt solutions. The pin and socket termination blocks with seals installed withstood all leakage, pressure, breakdown or flash-over tests.

For example, when a test voltage was applied between alternately connected contacts and between contacts and the body for a period of one minute minimum at a test voltage of 60 Hz rms, the connector halves were examined and found to have withstood a dielectric voltage of 3600 Vrms without degradation of signs of arcing. In another test, a partially wired plug and receptacle which were mated, but without center locking hardware, was placed in a container filled with salt water having a solution strength of 5% by weight. The wire bundle was terminated to a dielectric strength tester located outside of an altitude chamber and the other wire bundle was left unsupported in the chamber. The altitude chamber pressure was then reduced to 13.2 mm Hg (simulating 90,000 feet altitude) and maintained for 30 minutes. The chamber pressure was then returned to atmospheric pressure and the pressure were changed for several cycles. At the completion of the last cycle, while the mated connector was still immersed in the salt water bath, the dielectric withstanding voltage and insulation resistance tests were performed and met the dielectric withstanding voltage requirement at 1000 Vrms minimum and an insulation resistance requirement at a minimum of 5000 magohms. As consequence of these tests and others, the present invention met and exceeded all requirements.

Thus, it is obvious that the present invention is provided with many novel and useful aspects with reference to both the successful verification of the process and to the quality of the seals.

Although the invention has been described with reference to particular embodiments thereof, it should be realized that various changes and modifications may be made therein without departing from the spirit and scope of the invention.

What is claimed is:

1. A pressure sensitive seal for sealing means for terminating electromagnetic signal carrying means within a termination body having means therein for defining a bore, comprising:

means for defining a resilient seal positionable in the bore means for enabling a sealable engagement between the bore means and a peripheral portion of the termination means, said resilient seal means including means responsive to pressure for enhancing the sealing engagement against entry of fluids into the bore means when pressures external to the bore means exceed pressures internal to the bore means and for permitting exhaust of fluids from the bore means when pressures internal to the bore means exceed pressures external to the bore means.

2. A pressure sensitive seal as in claim 1 in which the termination body includes means for defining an opening of the bore means to the external pressures wherein:

said pressure responsive means includes a cup-shaped element comprising means for defining a radially extending flange engaging one of the bore means and the peripheral portion of the termination means, said flange means being bent towards the opening means of the bore means.

3. A pressure sensitive seal as in claim 1 wherein said resilient means further includes means extending from said pressure responsive means towards the entry of the bore means for sealing against the termination means.

4. A pressure-sensitive seal as in claim 1 in which a second termination body is provided having therein means for defining a bore for receiving therein a second termination means having a peripheral portion, both the termination bodies including means for defining openings of both the bore means to the external pressures, wherein:

said pressure-responsive means includes a pair of cup-shaped element each comprising means for defining terminal flanges for engaging in each of the termination bodies respectively one of the bore means and the peripheral portion, both said flanges means being bent towards both the opening means of both the bore means and facing one another.

5. A pressure sensitive seal as in claim 1 wherein said resilient means further includes a compression element spaced from said pressure-responsive means for compressing and continuously sealing against the bore means of the termination body, for wiping and cleansing of the bore means, and for providing a substantially clean surface of the bore means for enhancing the sealing engagement between said pressure-responsive means and the bore means.

6. A pressure sensitive seal as in claim 5 in which the termination body includes means for defining an opening of the bore means to the external pressures, wherein:

said pressure-responsive means includes a cup-shaped element comprising means for defining a radially extending flange engaging one of the bore means and the peripheral portion of the termination means, said flange means being bent towards the opening means of the bore means.

7. A pressure sensitive seal as in claim 6 in which the termination means includes a flexible second peripheral portion having a specific cross-sectional dimension, wherein:

said resilient means further includes means for defining a resilient tube of internal dimension less than the external dimension of the flexible peripheral portion for gripping and sealing against the flexible peripheral portion of the termination means and for maintaining said gripping and sealing during any flexing of the termination means, said cup-shaped element and said flange means being positioned intermediate said resilient tube means and said compression element.

8. A pressure-sensitive seal for individually sealing electromagnetic signal carrying means within means for defining an opening in a connector block including a substantially tubular member having an internal surface and an external peripheral surface with one of said surfaces being sealed to the electromagnetic signal carrying means, said tubular member further having a resilient flange extending radially from the other of said surfaces and from the axis of said member, said radially extending resilient flange having means for enabling bending and sealing thereof in the opening means of the connector block when the electromagnetic signal carrying means and said tubular member are both inserted into the opening means of the connector block and thereby for enhancing the sealing of the electromagnetic signal carrying means with the opening means when pressures external to the opening means exceed pressures internal to the opening means and for permitting exhaust of fluids from the opening means when pressures internal to the opening means exceed pressures external to the opening means.

9. A pressure-sensitive seal as in claim 8 wherein said tubular member further includes a flexible tubular segment axially spaced and extending freely from said flange for gripping and sealing against the electromagnetic signal carrying means even when the signal carrying means is flexed and when the signal carrying means has surface discontinuities therein.

10. A pressure sensitive seal as in claim 8 wherein said tubular member further includes a substantially continuous annular land axially spaced from said flange for wiping and cleansing of the opening means and for providing a substantially clean surface thereof for enhancing the sealing of said flange with the opening means when inserted therein and sealed therewith.

11. A pressure-sensitive seal as in claim 8 wherein said tubular member further includes a second resilient flange extending radially from the axis of said member and axially from said first-mentioned resilient flange for sealing within individual and separate means for defining two of the connector block opening means when the connector blocks are brought together.

12. A pressure sensitive seal for a single electromagnetic signal termination contact including:

a substantially tubular member sealingly engaged with said contact and having an external peripheral surface, and a mechanical interengagement securing said member and said contact together as a unit; and a resilient flange extending radially outwardly from said external peripheral surface and from the axis of said member, said radially extending resilient flange having means for enabling bending and sealing thereof with means for defining a bore for a connector block into which said interengaged contact and member unit are insertable as a unit, said mechanical interengagement in cooperation with said bore means capable of resisting relative slippage between said member and said contact when said interengaged contact and member unit are inserted into said bore means.

13. A pressure-sensitive seal for an electromagnetic signal termination contact including:

a substantially tubular member having an internal surface and an external peripheral surface;

a resilient flange extending radially from one of said surfaces and from the axis of said member, said radially extending resilient flange having means for enabling bending thereof when inserted into and sealed with means for defining a bore of a connector block;

said tubular member further having a tubular segment substantially at one end thereof, an annular peripheral land substantially adjacent the other end thereof for wiping and cleansing of said bore means for providing a substantially clean surface thereof for enhancing the sealing of said flange with said bore means when inserted and sealed therewith, and means for defining an internal recess in said internal surface positioned substantially intermediate said radially extending flange and said annular peripheral land.

14. A pressure-sensitive seal for a contact for terminating electromagnetic signal carrying means including: a substantially tubular member having an internal surface and an external peripheral surface and having first and second resilient flanges positioned adjacent the ends of said member and extending radially from one of said surfaces and from the axis of said member, said radially extending resilient flanges respectively having means for enabling bending thereof when inserted into and sealed with individual and separate means for defining bores of connector blocks when the connector blocks are brought together, and means for securing said tubular member to the contact, and a pair of thickened supports extending respectively from said resilient flanges to said ends.

15. A pressure-sensitive seal as in claim 14 further including a third thickened support positioned intermediate said resilient flanges.

16. A pressure-sensitive seal for a contact for terminating electromagnetic signal carrying means including a substantially tubular member having an internal surface and an external peripheral surface and having a resilient flange extending radially from one of said surfaces and from the axis of said member, said radially extending resilient flange having means for enabling bending thereof when inserted into and sealed with means for defining a bore of a connector block, and means for securing said tubular member to the contact, said tubular member further including a flexible tubular segment spaced substantially axially and extending freely from said flange for gripping and sealing against the electromagnetic signal carrying means even when the signal carrying means is flexed and when the signal carrying means has surface discontinuities therein.

17. A pressure-sensitive seal for a contact for terminating electromagnetic signal carrying means including a substantially tubular member having an internal surface and an external peripheral surface and having a resilient flange extending radially from one of said surfaces and from the axis of said member, said radially extending resilient flange having means for enabling bending thereof when inserted into and sealed with means for defining a bore of a connector block, and means for securing said tubular member to the contact, said tubular member further including a substantially continuous annular land spaced from said flange for wiping and cleansing of the bore means and for providing a substantially clean surface thereof for enhancing the sealing of said flange with the bore means when inserted therein and sealed therewith.

18. A pressure-sensitive seal for a contact for terminating electromagnetic signal carrying means including a substantially tubular member having an internal surface and an external peripheral surface and having first and second spaced resilient flanges extending radially from one of said surfaces and from the axis of said member, said radially extending resilient flanges each having means for enabling bending thereof when inserted into and sealed respectively with individual and separate means for defining bores of two connector blocks and when the connector blocks are brought together, and means for securing said tubular member to the contact.

* * * * *